US010047589B2

(12) United States Patent
Boyd et al.

(10) Patent No.: US 10,047,589 B2
(45) Date of Patent: Aug. 14, 2018

(54) AUTOMATIC RELEASE VALVE FOR A BUMPER SPRING

(71) Applicant: Flowco Production Solutions, Spring, TX (US)

(72) Inventors: Garrett S. Boyd, Godley, TX (US); Mitchell A. Boyd, Haslet, TX (US)

(73) Assignee: Flowco Production Solutions, LLC, Spring, TX (US)

( * ) Notice: Subject to any disclaimer, the term of this patent is extended or adjusted under 35 U.S.C. 154(b) by 251 days.

(21) Appl. No.: 15/015,411

(22) Filed: Feb. 4, 2016

(65) Prior Publication Data

US 2016/0222758 A1 Aug. 4, 2016

Related U.S. Application Data

(60) Provisional application No. 62/111,845, filed on Feb. 4, 2015.

(51) Int. Cl.
*E21B 34/08* (2006.01)
*E21B 43/12* (2006.01)

(52) U.S. Cl.
CPC ..... *E21B 34/08* (2013.01); *E21B 43/121* (2013.01)

(58) Field of Classification Search
CPC ..... E21B 34/08; E21B 43/121
See application file for complete search history.

(56) References Cited

U.S. PATENT DOCUMENTS

| | | | | |
|---|---|---|---|---|
| 4,951,752 | A | 8/1990 | Coleman | |
| 6,554,580 | B1 | 4/2003 | Mayfield et al. | |
| 7,954,545 | B2 | 6/2011 | Hearn et al. | |
| 8,757,267 | B2 | 6/2014 | Mitchell et al. | |
| 2006/0124292 | A1* | 6/2006 | Victor | E21B 17/07 166/68 |
| 2011/0259438 | A1* | 10/2011 | Osborne | E21B 34/08 137/115.13 |
| 2012/0318524 | A1* | 12/2012 | Lea, Jr. | E21B 43/121 166/372 |

* cited by examiner

*Primary Examiner* — Brad Harcourt
(74) *Attorney, Agent, or Firm* — Whitaker Chalk Swindle & Schwartz PLLC; Stephen Mosher

(57) ABSTRACT

An automatic release valve assembly for a bumper spring, comprising a hollow cylindrical valve seat sleeve having a plurality of flow ports and flow passages disposed in the sidewalls thereof; a valve ball sized to engage by contact with a robust valve seat; a multiple coil spring disposed over the sleeve portion of the valve seat sleeve; wherein the valve seat sleeve, ball, and coil spring are enclosed within a hollow cylindrical housing. The housing includes within its bore a central region of a plurality of parallel, elongated and interleaved grooves and ridges to permit released fluid to flow and to stabilize the operation of the valve assembly.

14 Claims, 4 Drawing Sheets

AUTOMATIC RELEASE VALVE FOR A BUMPER SPRING

CROSS REFERENCE TO RELATED APPLICATIONS

The present application is related to and claims priority to U.S. Provisional Patent Application Ser. No. 62/111,845 filed Feb. 4, 2015 by the same inventors and entitled AUTOMATIC RELEASE VALVE FOR BUMPER SPRING, incorporated herein by reference. The present application is also related to U.S. patent application Ser. No. 14/996,828 filed Jan. 15, 2016 and entitled ROBUST BUMPER SPRING ASSEMBLY.

BACKGROUND OF THE INVENTION

1. Field of the Invention

The present invention generally relates to tools for use in oil and gas well operations, and more particularly to improvements to bumper spring tools for use in oil and gas wells.

2. Background of the Invention and Description of the Prior Art

A newly drilled and completed well typically has enough pressure within the formation to cause liquids in the formation and the well to flow to the surface without aid. Over time, however, as the well's production volume and bottomhole pressure decline the liquids fall back on the perforations—the passages into the formation—thus creating what is called a "loaded well" condition. In this condition the well no longer has sufficient pressure to cause the liquids to flow to the surface without some artificial lift.

A plunger lift is a type of artificial lifting device utilized in oil and gas wells to efficiently unload liquids. The system usually requires no external energy to provide the necessary pressure to lift the liquids to the surface, instead relying on the residual pressure in the well to lift the plunger.

The gas-to-liquid ratiorequired varies depending on many conditions. The common rule of thumb used in the industry is 300 to 400 scf per barrel per 1000' of depth.

A conventional plunger lift system for controlling production typically comprises the following structures. A well is formed by a casing that lines the well. Within the casing is a tubing string that lines the well bore through which oil or gas is produced from a formation through perforations. Within the well bore is a bumper spring assembly resting in a seating nipple or, alternatively, in a tubing or collar stop or hold down device as used in lieu of a seating nipple. A lift or bypass plunger, shown traveling upward under the pressure of the fluids and/or gas in the well bore, pushes or lifts a "slug" of fluid ahead of it. The weight of the fluid that lift or bypass plunger may lift depends on a variety of factors. Thus, it is important that other devices used in conjunction with bumper springs and lift plungers be appropriately matched to utilize the capabilities of all components in the downhole "system" so that they operate together for maximum efficiency and reliability. A typical well also includes the wellhead apparatus disposed on the surface of the earth for directing the production of the well to appropriate receptacles or pipelines.

A bumper spring assembly is a tool that is typically placed in a seating nipple at the lower end of the tubing in the well to absorb the momentum of the bypass or lift plunger as it reaches the seating nipple, thereby protecting the seating nipple from damage. Structurally, most bumper springs comprise a shaft or mandrel, a head piece at the upper end and a cage attached to the lower end. The head piece and cage are typically threaded onto the mandrel and secured with a pin to prevent the rotation of the end piece with respect to the mandrel so that the bumper spring does not become disassembled. Other methods to prevent loosening of the end pieces include welding and lock nuts.

In a typical well fluids may accumulate above the bumper spring assembly and impede production. The use of a ball-and-seat valve at the bottom of the well that opens during production flow but lacks the capability to release fluids above it when production ceases is one such example. Another example is to provide bypass relief around the ball-and-seat portion of the valve by notching the valve seat so that some of the fluid will always seep back into the formation during a close cycle. The only control of such method is the size of the notches in the valve seat, which is a poor compromise of valve effectiveness at best because it allows no control over the rate of flow during the release phase.

Some control may be provided by adding a coil spring below the ball-and-seat valve that compresses somewhat in response to fluid accumulation above the valve. When the accumulated fluid exceeds the tension in the spring, the valve opens to release fluid into the formation. A disadvantage of this type of assembly is that lack of a sleeve to stabilize the spring exposes the spring, which may typically be a wave spring—a coil spring wound of flat spring stock, to strong forces during production that may damage the spring. This lack of protection for the spring subjects the spring to reduced effectiveness in controlling release of accumulated fluids. Further, if the spring fails or collapses due to damage, there is no control of fluid release when production flow ceases. Other release valve assemblies include a sleeve inside the coil spring to stabilize it when the valve is open, and an O-ring around a floating valve seat to stabilize and seal the motion of the seat along the sleeve. While some protection and efficiency is gained, the release control is limited and the spring may still be subjected to severe forces. Moreover, the spring remains subject to failure from debris accumulation (e.g., sand and other solid matter).

Accordingly there is a need for an improved automatic release valve mechanism that provides both efficient automatic control of the release function and structural durability during use in the severe downhole environment.

SUMMARY OF THE INVENTION

Accordingly there is provided an automatic release valve assembly for a bumper spring, comprising a hollow cylindrical valve seat sleeve having a head end and a tail end with a valve seat formed at the head end and a sleeve portion formed at the tail end of the valve seat sleeve; a valve ball sized to engage by contact with the valve seat; a multiple coil spring disposed over the sleeve portion of the valve seat sleeve; and a cylindrical housing formed with a bore therethrough for enclosing the assembly of the valve seat sleeve, the valve ball, and the multiple coil spring; wherein the housing includes a region of a plurality of parallel, elongated and interleaved grooves and ridges formed within; and wherein the housing further includes first and second threaded ends thereof for engaging connecting threads respectively of a bumper spring cage and a bumper spring hold down.

In one aspect the elongated flow grooves are formed to a first inside diameter interleaved with parallel elongated ridges machined to a second, lesser inside diameter of the splined bore.

In other aspects, the automatic release valve assembly includes (a) flow ports and flow passages formed in the head end and the sleeve portion at the tail end respectively of the valve seat sleeve; (b) the valve seat is formed to a spherical profile to match the shape of the ball valve; (c) the coil spring is a wave spring formed to a predetermined spring constant; (d) the inner bore of the cylindrical housing includes a plurality of parallel, elongated and interleaved grooves and ridges; and (e) the cylindrical housing includes threads at each end for connection to a bumper spring cage and to a bumper hold down device.

DETAILED DESCRIPTION OF THE INVENTION

In an advance in the state of the art, the automatic release valve assembly of the present invention solves the aforementioned problems of efficiency and durability. The structural assembly includes a housing to support and contain the valve assembly and provide protection from debris suspended and carried by the fluids. Several flow relief features are provided in the internal sleeve to enhance fluid flow through the valve and internal sleeve assembly during flow release, thus bypassing much of the fluid flow that would otherwise attempt to flow through the coils of the spring. These features provide a substantial improvement in efficiency because of the increase flow capability. A wave or coil spring may be used to control fluid release. The tension in the spring may be controlled by setting the spring constant to a predetermined specification or by the use of a spacer to adjust the installed length of the spring. Either of these methods may be used to calibrate the valve opening for release of fluid into the formation in a variety of fluid accumulations and to hold the valve closed to support fluid above the valve as long as the weight of the accumulated fluid is within the 'hold' range of the release valve.

This novel and durable combination of features cooperates to provide reliable automatic control of the release of fluids into the formation and suspend the release until the accumulation threshold is exceeded and the release flow resumes. As will be described, the automatic release valve assembly is enclosed in a protective housing that is threadably connected between the bumper spring cage and a hold down device at the bottom of the well. As thus disposed, the valve is positioned for maximum effectiveness and durability, while controlling the amount of fluid that a traveling plunger is designed to lift to the surface.

Figure 1:
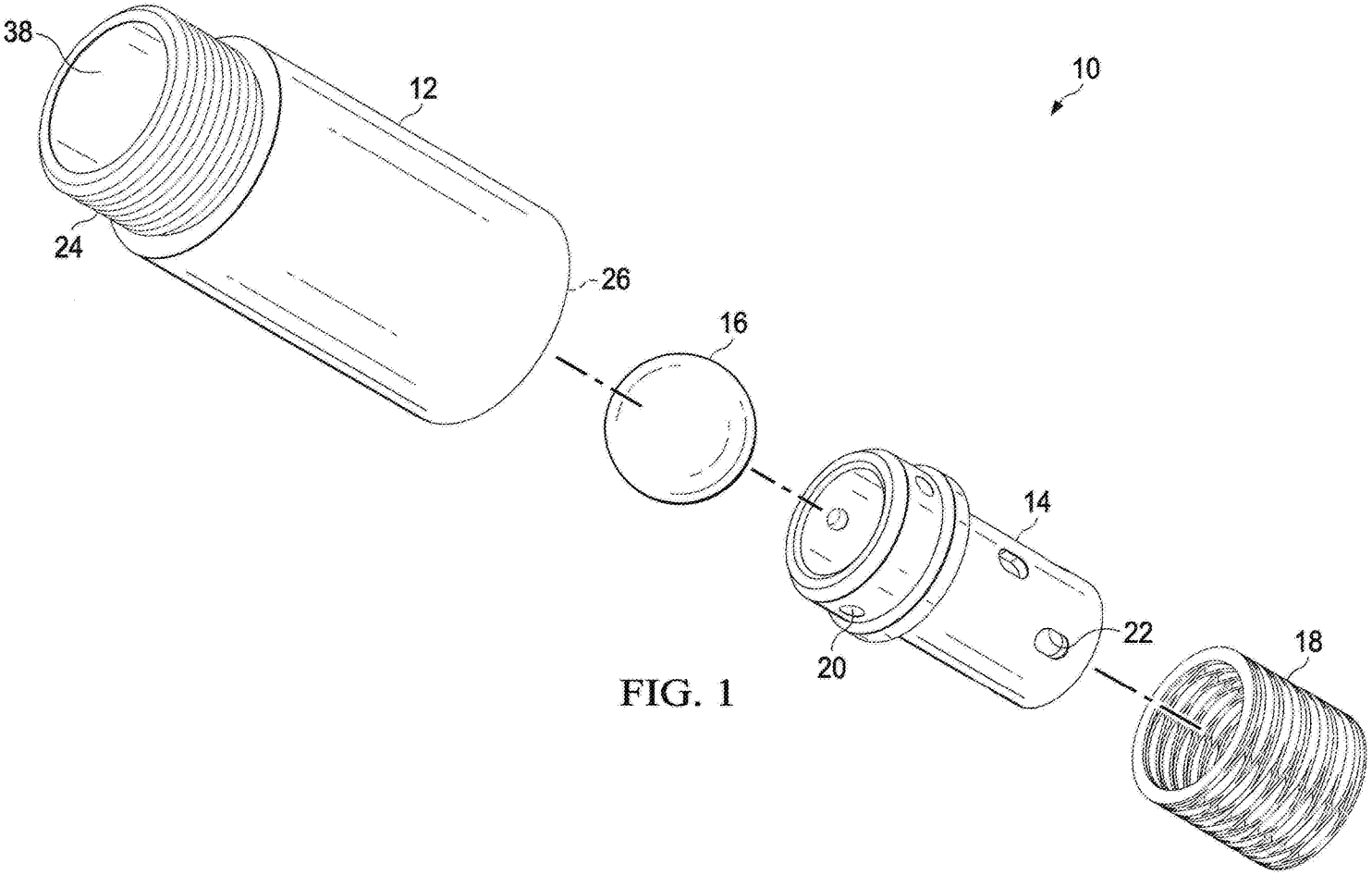
FIG. 1 illustrates a perspective exploded view of an automatic release valve assembly according to one embodiment of the present invention.

FIG. 1 illustrates a perspective exploded view of an automatic release valve assembly 10 according to one embodiment of the present invention. The valve assembly 10 includes a housing 12, a valve seat sleeve 14, a valve ball 16, and a coil spring 18, preferably a wave spring formed of edge-wise wound coils of flat spring stock to a predetermined spring constant. The valve seat sleeve may be a one piece component having a head end formed with a ball valve seat and a tail end formed as a sleeve. The valve assembly 10 may include a spacer 30 to be described in FIG. 2. The valve seat sleeve 14 includes a plurality (preferably three) of round flow passages 20 disposed around the circumference of the head end sidewall of the valve seat sleeve 14. These three round flow ports 20 may include chamferred edges or ingress ramps 21 machined into the leading edge of each round flow port 20. The valve seat sleeve 14 may preferably be formed as a one-piece hollow cylindrical unit that further includes a plurality (preferably six) oval flow passages 22 disposed around the circumference of the sidewall of the valve seat sleeve 14. The oval flow passages 22 may include chamferred edges (not shown) machined into the outer edge of each oval flow passage 22. The housing 12 includes external threads 24 at a first end for threadably connecting to the lower end of a bumper spring cage 102 (See FIG. 4). The housing 12 further includes internal threads 26 at the second end thereof for threadably connecting to the upper end of a hold down device 104 (See FIG. 4). In the following figures, reference numbers that appear in more than one figure identify the same structural feature.

Figure 2:
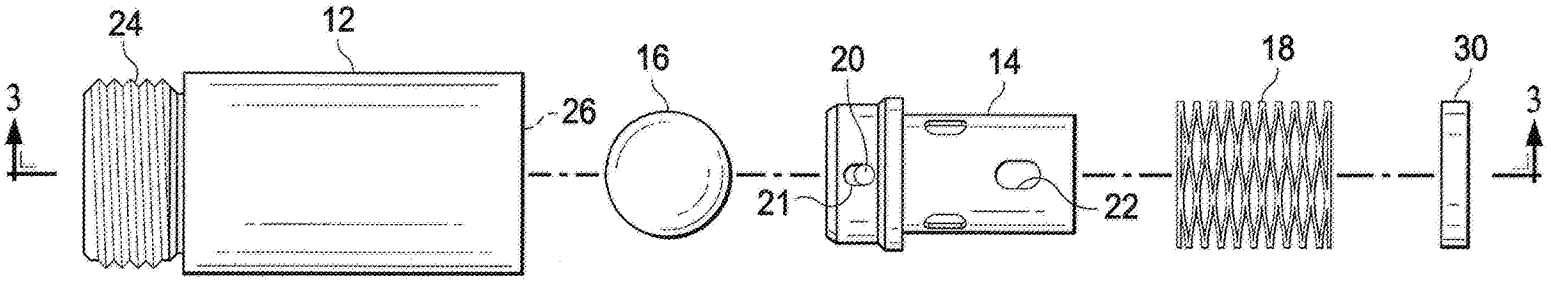
FIG. 2 illustrates a side view of the components of the embodiment of FIG. 1 along a longitudinal axis.

FIG. 2 illustrates a side view of the components of the embodiment of FIG. 1 along a longitudinal axis. The components shown include the housing 12, the valve seat sleeve 14, the valve ball 16, the wave spring 18 and the spacer 30. The spacer 30 may be varied in thickness to adjust the tension in the wave spring 18 to suit a particular application or conditions of use. The housing 12 includes external threads 24 at the end for connecting to a bumper spring cage 102 and internal threads 26 for connecting to a hold down device 104. The valve seat sleeve 14 is shown with chamferred relief ports 20 (with chamferring 21) and the oval flow ports 22 in the side walls of the valve seat sleeve 14.

Figure 3:
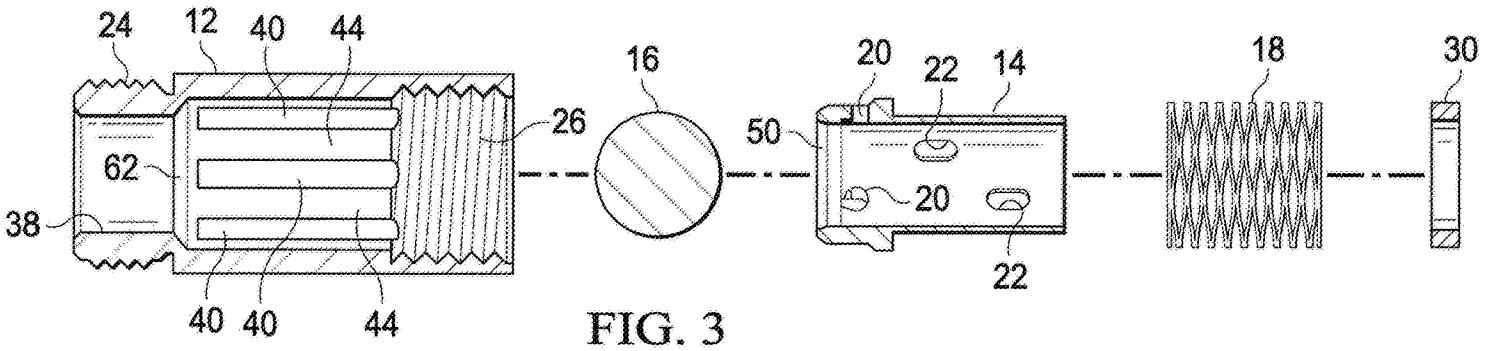
FIG. 3 illustrates a cross section view of the embodiment shown in FIG. 2.

FIG. 3 illustrates a cross section view of the embodiment shown in FIG. 2. The additional features of this cross section view include the internal structure of the housing 12 and the valve seat sleeve 14. The internal bore 38 of the housing 12 includes a series of grooves 40 interleaved with a series of ridges 42 surrounding the internal bore 38 of the housing 12. The interleaved grooves and ridges should include at least four of each but may include as many as eight of each. The grooves 40 are disposed along an inside diameter that is slightly larger than the inside diameter of the top surfaces 44 of the ridges 42. The grooves 40 provide passages for released fluids to flow through the housing 12 and into the valve seat sleeve 14. The surfaces 44 of the ridges 42 provide a sealing surface by contact with the outer diameter of the ball valve seat sleeve 14 and also serve to stabilize the motion of the ball valve seat sleeve assembly within the housing 12.

Also shown in FIG. 3 are the internal threads 26 for connecting the housing 12 and the enclosed ball valve 16 and valve seat sleeve 14 assembly to a hold down device 104. A sealing surface 62 disposed around the circumference of the internal bore 38 of the housing 12 is provided as a seal against the ball valve seat 50 machined in the head end of the valve seat sleeve. Other features of FIG. 3 are as described previously. When assembled, as shown FIGS. 4 and 5, the fluid 110 flows into the housing 12, through the grooves 40, around and through the ball valve 16, through the chamferred flow ports 20 and the interior of the sleeve 14, from which it may exit and be released into the formation. Note that the cross section of the head end of the valve seat sleeve 14 is thicker to resist flaring damage from the valve ball 16 impacts that are likely to occur during operation.

Figure 4:
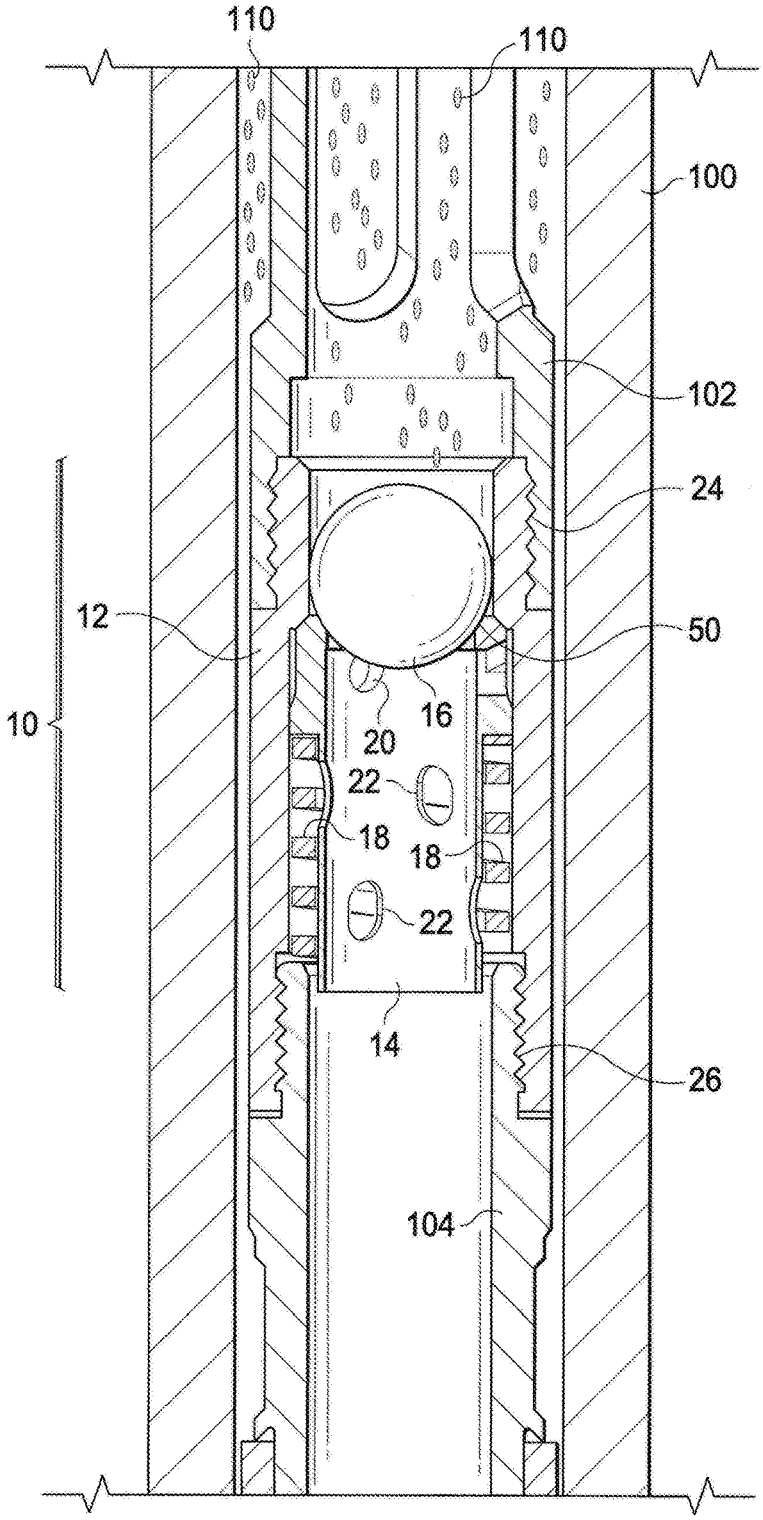
FIG. 4 illustrates a cross section view of the assembled release valve in situ within a well tubing and connected between a bumper spring cage and a bumper spring hold down device, with the automatic release valve in a closed position.
Figure 5:
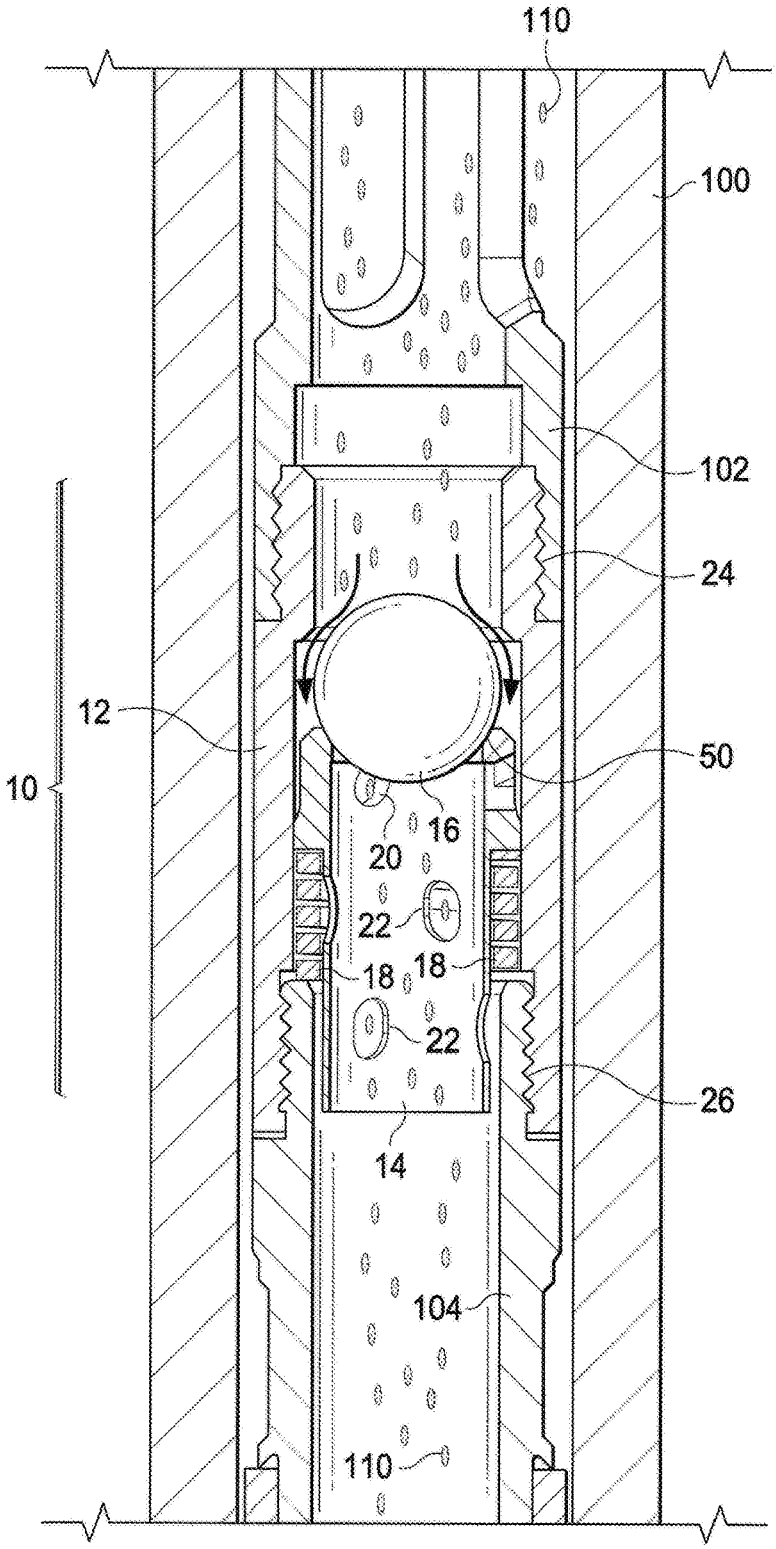
FIG. 5 illustrates the embodiment of FIG. 4 with the automatic release valve in an open position.

FIGS. 4 and 5 illustrate a cross section view of the assembled automatic release valve 10 in situ within a well tubing 100 and connected between a bumper spring cage 102 and a bumper spring hold down device 104. The automatic release valve 10 is shown in a closed position in FIG. 4 and in an open position in FIG. 5. Otherwise, the structural details are identical. In the figures, the ball valve 16 is shown seated against the valve seat 50 of the valve seat sleeve 14 and the ball valve assembly 10 is shown housed within the housing 12. The wave spring 18 is shown surrounding the outer diameter of the sleeve 14. In FIG. 4 the wave spring 18 is in its extended disposition or free state, which urges the ball valve assembly 10 upward to seal the lower end of the bumper spring cage 102, thereby retaining any accumulated fluid 110 above the ball valve assembly 10. The fluid 110, represented by the dark oval dots is shown blocked from passing through the ball valve assembly 10.

In FIG. 5 the wave spring 18 is shown in a compressed condition against the tension in the wave spring 18, the compression caused when the weight of the accumulated fluid above the ball valve assembly 10 exceeds the set threshold of the tension in the wave spring 18 and opens the ball valve assembly 10. In a typical application, the threshold—the tension of the wave spring 18—is set to equal the weight of ½ barrel of fluid—whether it be oil or some other fluid material—accumulated above the plunger. When thus open, the fluid is allowed to flow downward—i.e., released—into the formation (not shown) below the ball valve assembly 10. The released fluid 110 flows around the ball valve 16 in the space within the housing 12 (see the arrows), through the flow ports 20 into the inside of the ball valve sleeve 14, through the ball valve sleeve 14 and downward into the formation.

The automatic release valve assembly of the present invention may be constructed of high-strength materials such as alloy steel, stainless steel, titanium, or other materials that can withstand the abusive and harsh environment at the bottom of an oil or gas well. If a spacer 30 is used (See FIG. 2), its thickness can be varied in increments to adjust the release threshold so that it corresponds to ½ barrel or ¼ barrel, etc.

The present invention provides a number of advantages due to its novel combination of features. The invention requires no O-ring seal, instead incorporating a taper seal configuration at the valve seat end of the one-piece valve seat sleeve that provides improved fluid flow when the valve is open. The valve seat is more robust due to thicker side walls, to resist damage (and loss of sealing capacity) from flaring or other heavy impacts. Further, when the valve is releasing fluid most of the flow is through the sleeve and not through the spring, thus reducing the opportunity for debris to load up and clog the spring. There is also no flaring of the valve seat or sleeve because of the more precise configuration of the seat and the adjoining tapered edges. These features together accommodate flow rates several times greater than the conventional release valves as well as increased reliability. The relieved flow passages also act to keep the spring flushed of debris, thus preventing the spring from loading up with debris and locking up. The spring is afforded maximum protection by the present invention; even if the spring fails over time and becomes fully compressed, fluid can still fall through the valve assembly and not load up the well.

While the invention has been shown in only one of its forms, it is not thus limited but is susceptible to various changes and modifications without departing from the spirit thereof.

What is claimed is:

1. An automatic release valve assembly for a bumper spring, comprising:

a hollow cylindrical valve seat sleeve having a head end and a tail end with a valve seat formed at the head end and a sleeve portion formed at the tail end of the valve seat sleeve;

a valve ball sized to engage by contact with the valve seat;

a multiple coil spring disposed over the sleeve portion of the valve seat sleeve; and a cylindrical housing formed with a bore therethrough for enclosing the assembly of the valve seat sleeve, the valve ball, and the multiple coil spring; wherein the housing includes a plurality of parallel, grooved flow passages disposed within its internal bore; and wherein the housing further includes first and second threaded ends thereof for engaging connecting threads respectively of a bumper spring cage and a bumper spring hold down.

2. The assembly of claim 1, wherein:

the head end of the valve seat sleeve includes a plurality of flow ports formed in a sidewall thereof; and the sleeve portion of the valve seat sleeve includes a plurality of flow passages formed in a sidewall thereof.

3. The assembly of claim 2, wherein:

the number of flow ports formed in the head end of the valve seat sleeve is three; and the number of flow passages formed in the sleeve portion of the valve seat sleeve is six.

4. The assembly of claim 1, wherein:

the valve seat is formed to a profile that matches the spherical shape of the valve ball.

5. The assembly of claim 1, wherein:

the multiple coil spring is a wave spring having a plurality of uniform coils formed to provide a predetermined spring constant.

6. The assembly of claim 1, wherein:

at least four parallel grooved flow passages are disposed within the internal bore of the housing.

7. The assembly of claim 1, wherein:

the first end of the cylindrical housing comprises an external thread for connection with a bumper spring cage.

8. The assembly of Claim 1, wherein:

the second end of the cylindrical housing comprises an internal thread for connection with a bumper spring hold down device.

9. An automatic release valve assembly for a bumper spring, comprising:

a hollow cylindrical valve seat sleeve having a head end and a valve seat formed at the head end and including at least three flow ports formed in a sidewall thereof, and a tail end having a sleeve portion formed at the tail end of the valve seat sleeve, wherein the sleeve portion of the valve seat sleeve includes at least six flow passages formed in a sidewall thereof;

a valve ball sized to engage by contact with the valve seat;

a multiple coil spring disposed over the sleeve portion of the valve seat sleeve; and a cylindrical housing formed with a bore therethrough for enclosing the assembly of the valve seat sleeve, the valve ball, and the multiple coil spring; wherein the housing includes, disposed within its internal bore, a plurality of parallel, elongated and grooved flow passages interleaved with ridges formed within the internal bore; and wherein the housing further includes first and second threaded ends thereof for engaging connecting threads respectively of a bumper spring cage and a bumper spring hold down.

10. The assembly of claim 9, wherein:

the valve seat is formed to a profile that matches the spherical shape of the valve ball.

11. The assembly of claim 9, wherein:

the multiple coil spring is a wave spring having a plurality of uniform coils formed to provide a predetermined spring constant.

12. The assembly of claim 9, wherein:

at least four parallel grooved flow passages are disposed within the internal bore of the housing.

13. The assembly of claim 9, wherein:

the first end of the cylindrical housing comprises an external thread for connection with a Bumper spring cage.

14. The assembly of claim 9, wherein:

the second end of the cylindrical housing comprises an internal thread for connection with a bumper spring hold down device.

* * * * *